United States Patent [19]

Hartmann et al.

[11] Patent Number: 4,496,508

[45] Date of Patent: Jan. 29, 1985

[54] METHOD FOR MANUFACTURING POLYPROPYLENE SPUN-BONDED FABRICS WITH LOW DRAPING COEFFICIENT

[75] Inventors: Ludwig Hartmann; Ivo Rüzek; Engelbert Löcher, all of Kaiserslautern, Fed. Rep. of Germany

[73] Assignee: Firma Carl Freudenberg, Weinheim/Bergstrasse, Fed. Rep. of Germany

[21] Appl. No.: 416,701

[22] Filed: Sep. 10, 1982

[30] Foreign Application Priority Data

Dec. 24, 1981 [DE] Fed. Rep. of Germany ..... 3151322

[51] Int. Cl.[3] ..... D01D 5/20

[52] U.S. Cl. ..... 264/167; 264/176 F; 264/210.8; 264/518; 428/224; 428/227; 428/288

[58] Field of Search ..... 264/12, 176 F, 210.8, 264/518; 428/224, 198, 288, 227

[56] References Cited

U.S. PATENT DOCUMENTS

| | | | |
|---|---|---|---|
| 3,338,992 | 8/1967 | Kinney | 264/176 F |
| 3,509,009 | 4/1970 | Hartmann | 264/177 F |
| 3,528,129 | 9/1970 | Hartmann | 264/12 |
| 3,692,618 | 9/1972 | Dorschner et al. | 264/176 F |
| 3,707,838 | 1/1973 | Dorschner et al. | 264/518 |
| 3,802,817 | 4/1974 | Matsuki et al. | 264/210.2 |
| 4,064,605 | 12/1977 | Akiyama et al. | 264/109 |
| 4,100,319 | 7/1978 | Schwartz | 428/296 |
| 4,202,855 | 5/1980 | Gerking et al. | 264/176 F |
| 4,292,365 | 9/1981 | Kane et al. | 428/288 |
| 4,340,563 | 7/1982 | Appel et al. | 264/518 |

FOREIGN PATENT DOCUMENTS

| | | | |
|---|---|---|---|
| 51-88710 | 8/1976 | Japan | 264/210.8 |

*Primary Examiner*—Philip Anderson
*Attorney, Agent, or Firm*—Kenyon & Kenyon

[57] ABSTRACT

The present invention provides a method for manufacturing polypropylene spun-bonded fabrics, which method involves preparing a polypropylene melt at a temperature of about 240° to 280° C. and forming polypropylene filaments by extruding this melt through a spinning nozzle at an extrusion velocity of about 0.02 meter/second to 0.2 meter/second. The spinning nozzle, or spinneret, has holes with a diameter less than 0.8 millimeter. The filaments thus formed are subsequently quenched by transversely blowing air at a temperature between about 20° to 40° C. The filaments are also aerodynamically withdrawn by means sufficient to create a filament withdrawal velocity between about 20 meters/second and 60 meters/second. The ratio of the extrusion velocity to the withdrawal velocity (herein defined as the deformation ratio) is between about 1:200 and 1:1000. These aerodynamically withdrawn filaments are then deposited onto a moving porous support in order to form a continuous web. This web is then bonded by suitable means, forming a finished spun-bonded nonwoven fabric.

14 Claims, 2 Drawing Figures

METHOD FOR MANUFACTURING POLYPROPYLENE SPUN-BONDED FABRICS WITH LOW DRAPING COEFFICIENT

FIELD OF THE INVENTION

The present invention relates to a method for manufacturing polypropylene spun-bonded fabrics. More specifically, the method of the present invention provides for the manufacturing of polypropylene spun-bonded fabrics having a low draping coefficient.

BACKGROUND OF THE INVENTION

Spun-bonded fabrics in general, as well as polypropylene spun-bonded fabrics, are known. The term spun-bonding refers to a method for making nonwoven fabrics. In the spun-bonded process, a molten synthetic polymer is forced through a spinneret or spinning nozzle which is an essential device in the production of man-made fibers. The spinning nozzle looks much like a thimble punctured at its end with holes. As the molten polymer is rapidly forced through the holes of the spinning nozzle, a fine filament is produced. The continuous filaments formed in the spun-bonding process are then laid down on a moving conveyor belt to form a continuous web, which web is then bonded by thermal or chemical means.

Nonwoven fabrics so produced by spun-bonding have good textile-like properties, although not always comparable to woven or knit materials, especially with regard to feel. It is an object of the present invention to provide a method for manufacturing spun-bonded fabrics that are "textile-like", i.e., soft and adaptable and marked by a very low draping coefficient.

SUMMARY OF THE INVENTION

The present invention provides a method for manufacturing polypropylene spun-bonded fabrics, which method involves preparing a polypropylene melt at a temperature of about 240° to 280° C. and forming polypropylene filaments by extruding this melt through a spinning nozzle at an extrusion velocity of about 0.02 meter/second to 0.2 meter/second. The spinning nozzle, or spinneret, has holes with a diameter less than 0.8 millimeter. The filaments thus formed are subsequently quenched by transversely blowing air over them at a temperature between about 20° C. to 40° C. The filaments are also aerodynamically drawn by means sufficient to create a filament withdrawal velocity between about 20 meters/second and about 60 meters/second. The ratio of the extrusion velocity to the withdrawal velocity (herein defined as the deformation ratio) is between about 1:200 and 1:1000. The aerodynamically drawn filaments are then deposited onto a moving porous support in order to form a continuous web. This web is then bonded by suitable means, to provide a finished spun-bonded nonwoven fabric.

DETAILED DESCRIPTION OF THE INVENTION

Figure 1:
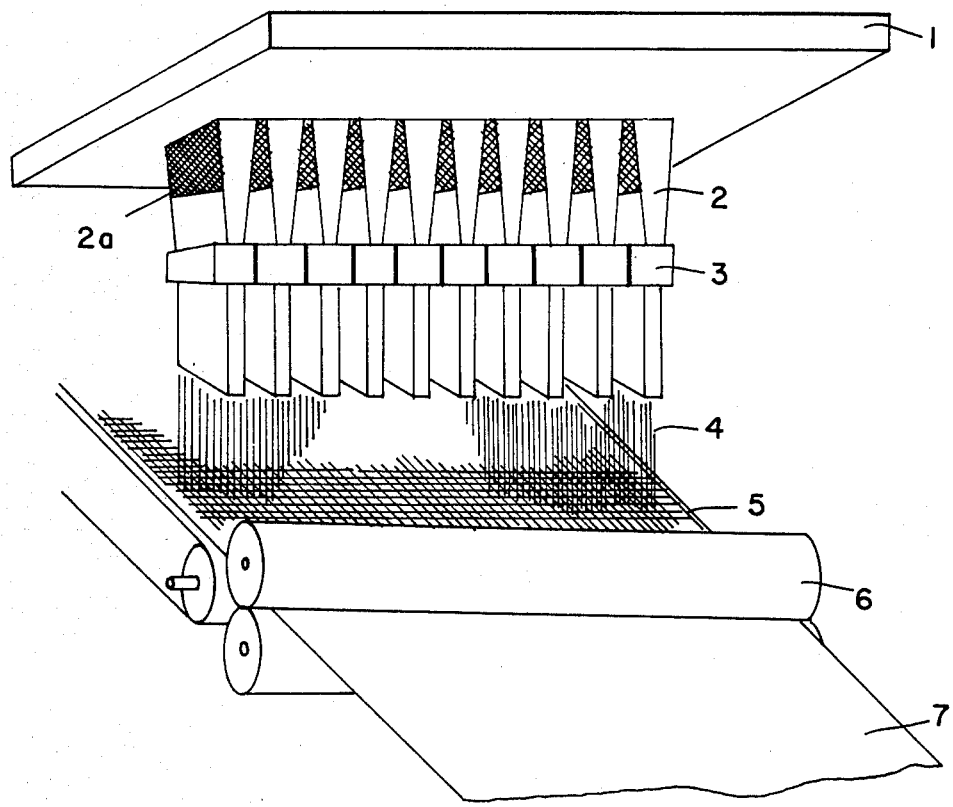
FIG. 1 is a representation of a device by which to produce the spun-bonded polypropylene fabrics according to the present invention.

It is known that the fibers or filaments forming a nonwoven fabric of high quality, must have high molecular orientation, i.e., the drawing ratio must be high enough. The purpose of orientation in the manufacture of synthetic fiber materials is the alignment of the macro-molecular chains in the direction of the longitudinal fiber axis, to increase fiber strength, to reduce the ultimate elongation. Many scientific methods are known by which the degree of orientation may be measured. For example, anisotropy may be measured by optical or acoustical means or by evaluation of X-ray scatter diagrams. Of course, as the degree of orientation, resulting from the drawing of the fibers, is related to the fibers' strength, it often is sufficient to differentiate between fibers or fiber products by determining the strength parameters of the fibers, such as tensile strength and maximum tensile elongation. For example, fibers to be used for technical purposes, with an appropriately high orientation of the fiber, may have a maximum tensile elongation value of less than 10%. In contrast, ordinary fibers and filaments for textile applications may be differentiated in that they may have elongation values of up to about 60%.

Drawn, as well as partially drawn or undrawn, fibers are used in the manufacture of nonwoven fabrics. While the drawn or highly oriented fibers comprise the actual fabric forming fibers, the partially drawn or undrawn fibers are commonly used only as bonding fibers.

Contrary to such conventional nonwoven fabrics, the polypropylene spun-bonded fabric according to the present invention is comprised of partially drawn polypropylene filaments as the fabric-forming fibers. Surprisingly, it has been found that nonwoven fabrics of the present invention not only have great strength in use, but also simultaneously exhibit a very soft, textile-like feel. Such properties are especially desirable in nonwoven fabric made for use in medical or hygiene articles. These novel properties are also very advantageous in so-called "composite planar structures", which comprise several layers of soft, nonwoven fabric materials.

The good textile-like properties of nonwovens produced according to the present invention are particularly unexpected and surprising because the partially drawn fibers used have a limp feel in their unprocessed condition, and it would not be expected that such "limp" fibers would result in a soft but very strong nonwoven fabric having excellent drapability. Another great advantage of the present invention relates to the bonding step, after the polypropylene filaments have been laid down on a conveyor belt typically used in spun-bonding. Excellent bonding can be effected by, for example, employing a calender embossing technique. By using a suitable calender embossing technique, it is not necessary to simultaneously employ bonding agents or extraneous bonding fibers. Also, in comparison to articles comprised of fully drawn fibers, the nonwovens of the present invention can be bonded by a calender embossing technique which employs substantially gentler pressure and temperature conditions.

The soft, textile-like property of the spun-bonded fabrics according to the present invention is the reason for the fabrics' good drapability. Drapability is determined in accordance with German Industrial Standard-DIN 54306, which is incorporated herein by reference. Drapability as that term is employed herein is determined according to DIN 54306, and is related to the degree of deformation observed when a horizontally lying planar structure subject only to the forces resulting from its own weight, is allowed to hang over the edge of a support plate.

Drapability measured in accordance with DIN 54306 is characterized in terms of the draping coefficient D, which is expressed as a percentage. Of course, the draping coefficient of the presently disclosed polypropylene spun-bonded fabrics is a critical parameter. The lower D is, the better drapability is, and consequently the feel of the planar structure is better.

Nonwoven fabric materials in accordance with the present invention are characterized by a draping coefficient, determined according to DIN 54306, which satisfies the following equation:

$$D \leqq 1.65FG + 30\ (\%)$$

wherein (FG) is the area weight of the particular material. Materials having a D value greater than that satisfying the equation above are considered too hard in the context of this invention, although such materials are textile-like.

Conventional fully drawn fibers used for the manufacture of nonwoven fabrics have maximum tensile elongation values of less than 100% of their original length, as determined by German Industrial Standard, DIN 53857, which is incorporated herein by reference. The term maximum tensile elongation as employed herein refers to maximum tensile elongation values determined in accordance with DIN 53857. In contrast, the partially drawn fibers employed by the present invention exhibit maximum tensile elongation values of at least about 200%, determined according to DIN 53857. Especially advantageous are fibers with maximum tensile elongation values of more than about 400% of their original length. Fibers within these preferred ranges can be manufactured by suitably adjusting the manufacturing parameters in the manner described below.

It is also important that the partially drawn fibers of the present invention be characterized by low fiber shrinkage, namely, shrinkage of less than about 10% as determined in boiling water. Fibers with higher fiber shrinkage would considerably disrupt fabric manufacture. A shrunk fabric obtained from fibers having such higher shrinkage would be much too dense and too hard because of shrinkage. It follows that the manufacture of the fibers should be directed to the preservation of the partially drawn and at the same time low-shrinkage properties of the fibers.

In order to obtain fibers satisfying the above-indicated parameters, i.e., partially drawn, high maximum tensile elongation, and low shrinkage, it was found that the spinning path of the filaments being extruded from the spinning nozzle had to be shortened considerably in comparison to the path in a conventional spunbonding process. As there is a shortened spinning path, i.e., shortened distance between extrusion of the filament from the spinning nozzle to its deposition on the moving conveyor belt, it is possible to accordingly set the ratio of the extrusion velocity to the withdrawal velocity so as to obtain a low deformation ratio. As will be explained more fully below, the extrusion velocity is preferably about 0.02 meters/second to about 0.2 meters/second, while the withdrawal velocity is about 20 meters/second to about 60 meters/second. The fibers are manufactured by setting the drawing parameters within the given ranges.

The present invention preferably involves the use of aerodynamic means for withdrawing the extruded filaments. Suitable aerodynamic withdrawing elements are known in the spun-bonding art. Although the energy required to create the air flow suitable to withdraw the filaments compared unfavorably to the energy required for known mechanical withdrawing systems, this air flow energy is minimized in accordance with the procedures of this method.

FIG. 1 is a representation of a device by which to produce the partially drawn polypropylene filaments with low shrinkage, in accordance with the present invention.

There is provided a spinning beam (1) to accommodate the heatable spinning nozzles. The spun filaments which are extruded from the spinning nozzles are cooled down in cooling wells (2), by virtue of air being drawn in through openings (2*a*) covered with screens. The filaments are subsequently partially drawn by virtue of their being subjected to the ejection action of withdrawal canals (3).

After the partially drawn groups of filaments (4) leave the withdrawal canals, they are deposited on a moving screen belt (5) to form a web. Deposition is aided by the action of a vacuum creating suction from below the screen. The web so formed is then bonded or solidified by the action of calender means (6). The finished nonwoven fabric web (7) is then rolled up.

The spinning operation, i.e., the operation of extruding a molten polymer through a spinning nozzle, takes place at polypropylene melt temperatures of about 240° C. to 280° C. The spinning nozzles have a multiplicity of holes, the diameter of which is less than about 0.8 mm, e.g., about 0.4 mm. The gear pump used to force the molten polymer through the spinning nozzle is suitably set so as to produce extrusion velocities of from about 0.02 (meters/second) m/s to about 0.2 m/s. The filaments so formed are guided through a free distance of at most about 0.8 m whereupon they enter an aerodynamic withdrawal element comprising the cooling wells and withdrawal canals The filaments are cooled by being transversely blasted by air at a temperature of about 20° C. to 40° C., which air is drawn in through the screened sides of the cooling wells (2) as a result of the injector effect of the aerodynamic means used to withdraw the filaments. Installation of screens into the walls of the cooling wells also permits equalization of the transverse air flow created. The suction action created by the aerodynamic drawing element should be adjusted so that there is a filament withdrawal velocity of about 20 m/s to 60 m/s. Appropriate withdrawal velocity is determined by consideration of the filament diameter and the continuity equation. For constant extrusion conditions, the spinning process can be controlled by the fiber diameter. The filament diameter permits determination of a range for the deformation ratio. The deformation ratio is defined as the ratio of the extrusion velocity to the withdrawal velocity. It should be about 1:200 to 1:1000 in order to produce the partially drawn filaments. The filaments may suitably have a filament titer of about 2.5 to 4.0 dtex, a maximum fiber tensile strength of about 10 to about 14 N/dtex and a maximum fiber elongation of about 450 to about 500%.

As mentioned above, the drawn filaments exiting from the withdrawal canals ultimately are deposited on a porous movable support or screen belt, aided by suction action which is created below the support.

Figure 2:
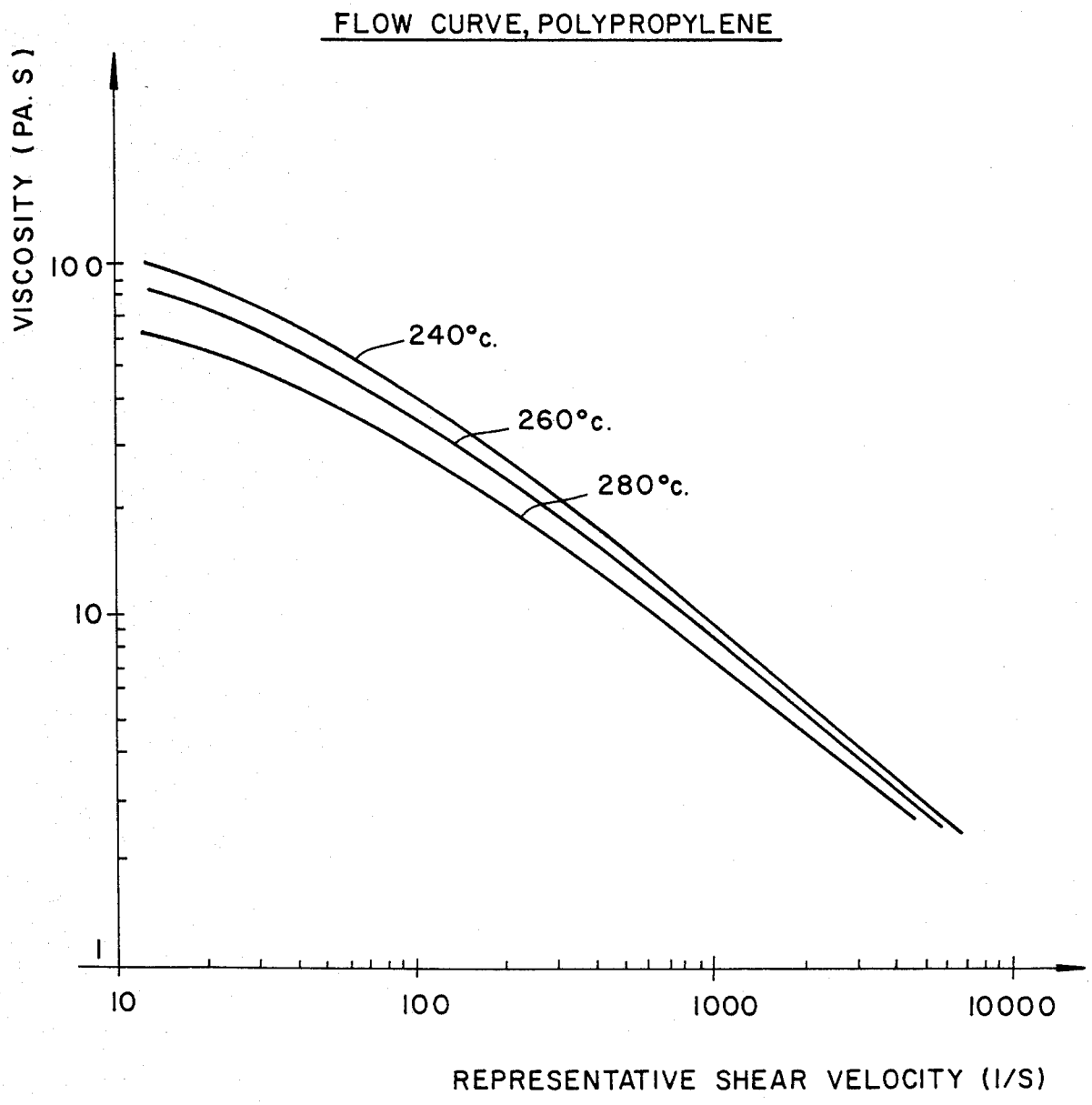
FIG. 2 graphically represents the change in melt viscosity of polypropylene, as a function of melting temperature and shear velocity.

Atactic polypropylene may be employed. In addition, polypropylene having a particularly narrow weight distribution is advantageously employed. Such a weight distribution can be achieved by, for example, breaking down polypropylene and regranulating it. Polypropylene having the desired weight distribution is characterized by a special relationship between its melt viscosity and shear velocity. In accordance with the present invention, it is stipulated that at a melting temperature of 280° C. and for a representative shear velocity of 362 l/s, the melt viscosity of desirable polypropylene will be in the range of about 45 pascal seconds (Pa.sec)+3%, while for a shear velocity of 3600 l/s, the melt viscosity is in the range of about 14 Pa.sec+2%, and finally for a shear velocity of 14,480 l/s, the melt viscosity is in the range of about 6 Pa.sec. 1.5%. FIG. 2 more clearly represents the change in melt viscosity of the polypropylene as a function of variation in shear velocity. Three melt temperatures are shown—240° C., 260° C. and 280° C.

To produce the soft feel and other properties of the presently disclosed nonwoven fabrics, it is preferred that the fabric be formed on the moving screen belt such that the filament withdrawal velocity effectuated by the aerodynamic withdrawal elements is about ten to twenty times that of the velocity of the moving support on which the fabric is formed. Fabric structure may also be improved by utilizing suitable means to produce an oscillating motion in the groups of filaments exiting from the aerodynamic withdrawal elements. This oscillation represents a third kinematic component of fabric formation. The velocity vector acting transversely to the fabric travel direction should be about 0 to 2 times the fabric travel velocity.

In order to produce a nonwoven fabric having properties consistent with those herein disclosed, (such as suitable density, and desirable gas and liquid permeability) it is preferred that the finished fabric not be characterized exclusively by individual filaments. Rather, it is preferred that the component filaments be partially combined to form alternating groups or light bundles of from about 2 to 5 filaments. Such bundles can be easily formed by suitably adjusting the internal cross-sectional area of the aerodynamic withdrawal element in relation to the number of filaments running through it. The device described in German Pat. No. 1560801 which is incorporated herein by reference also provides one option for controlling such bundle formation. When the filaments or bundles of filaments are deposited without preferred direction, i.e., in a random manner, the web so formed will naturally have a crossed parallel texture.

The nonwoven fabric web formed on the moving belt is bonded, or solidified, in a calender gap which consists of a smooth and an engraved cylinder. For purposes of the present invention, the temperature in the calender gap should be from about 130° C. to 160° C. Furthermore, only moderate line pressure is required, e.g., about 40 N/cm width to 500 N/cm width.

For some applications, it is necessary to adjust the surface tension of the fabric which consists of hydrophobic polypropylene fibers to a surface tension of $35\times10^{-5}$ N/cm by application of a suitable wetting agent so that the fabric is rendered wettable with aqueous and polar liquids.

The following example more fully describes the manufacture of a polypropylene spun-bonded fabric, in accordance with at least one embodiment of the present invention.

EXAMPLE

A spinning facility with two spinning stations was used. A polypropylene granulate was used which had viscosity characteristics consistent with the curve represented in FIG. 2. As discussed, FIG. 2 is a graphic representation of the melt viscosity of polypropylene as a function of shear velocity and melting temperature.

The polypropylene granulate was melted in an extruder to produce a melt with a temperature of 270° C. This melt was fed to the spinning stations, each station had a spinning pump and a nozzle block. The spinning plates had selectably, 600 and 1000 holes, each hole having a diameter of 0.4 mm. The freshly spun filaments extruded from these holes were blasted with cool air at a point underneath the spinning nozzle. The cooling section was 0.4 m long. The cooled filaments were then seized by an air stream in order to withdraw them.

After exiting from the withdrawing element, the bundles of filaments were subjected to an oscillating force, and then deposited on a screen belt that had a vacuum below it creating suction, to form a random fabric.

The various parameters of the above-described spinning process are tabulated in Table 1, below. The fibers or filaments produced during the process are partially drawn, of course. The fibers are more fully described by parameters tabulated in Table 2.

The fabric web formed on the screen belt was consolidated in a calender gap, characterized by cylinders set at a temperature of 160° C. and a line pressure to a value of 120 N/cm width. The calender gap consists of a smooth and an engraved cylinder. The engraved cylinder has 500,000 rectangular dots per square meter, with a side length of 0.7 mm each.

Finished nonwoven fabrics having area weights of 10, 15, 20 and 30 g/m$^2$, were produced by the process described above. Other parameters of these fabrics are tabulated in Table 3.

Part of at least one of the fabrics formed was finished in a bath containing a nonionic surfactant wetting agent, at a concentration of 10 g surfactant/liter. The treated fabric was dried. When subjected to a test with water adjusted to a surface tension of $35\times10^{-5}$ N/cm, prefect wettability was observed.

TABLE 1

| Spinning Parameters | |
|---|---|
| Melt temperature | 270° C. |
| Melt pressure | 20 bar |
| Throughput per hole | 0.5 g/min |
| Hole diameter | 0.4 mm |
| Cooling section | 0.4 m |
| Flow velocity of the pulling-off air | 30 m/s |
| Inside cross-section of withdrawing canal | 120 cm$^2$ |
| Temperature of the pulling-off air | 30° C. |
| Temperature of the engraved calender cylinder | 150° C. |
| Calender line pressure | 120 N/cm |

TABLE 2

| Fiber Data | |
|---|---|
| Filament titer | 2.5 to 4 dtex |
| Maximum tensile strength | 10 to 14 N/dtex |
| Maximum tensile elongation | 450 to 500% |

TABLE 3

| Nonwoven Fabric Data | | | | |
|---|---|---|---|---|
| Test | A | B | C | D |
| Area weight (g/m$^2$)* | 10 | 15 | 20 | 30 |
| Fabric thickness (mm) | 0.13 | 0.16 | 0.22 | 0.28 |
| Number of spot welds per cm$^2$ | 50 | 50 | 50 | 50 |
| Maximum tensile strength (N) | | | | |
| longitudinally | 15 | 25 | 33 | 60 |
| transversely | 15 | 25 | 32 | 50 |
| Maximum tensile elongation (%) | | | | |
| longitudinally | 80 | 70 | 81 | 67 |
| transversely | 80 | 65 | 85 | 71 |
| Tear propagation strength (N) | | | | |
| longitudinally | 5.5 | 6.5 | 11.0 | 13.0 |
| transversely | 5.5 | 6.5 | 10.5 | 13.0 |
| Draping coefficient (DIN5430) (%) | 40.7 | 47.2 | 61.5 | 74.1 |

*Fabrics made in accordance with the present invention will preferably have an area weight between 5 to 50 g/m$^2$.

The invention has been described in terms of specific embodiments set forth in detail, but it should be understood that these are by way of illustration only, and that the invention is not necessarily limited thereto. Modifications and variations will be apparent from this disclosure and may be resorted to without departing from the spirit of this invention, as those skilled in this art will readily understand. Accordingly, such variations and modifications are considered to be within the purview and scope of this invention and the following claims.

What is claimed is:

1. A method for manufacturing polypropylene spun-bonded fabrics, from partially-drawn polypropylene filaments, comprising:

preparing a polypropylene melt at a temperature of about 240° C. to 280° C.;

forming polypropylene filaments by extruding the melt through a spinning nozzle at an extrusion velocity of about 0.02 meters/second to about 0.20 meters/second, said spinning nozzle having holes with a diameter less than about 0.8 millimeter;

allowing the filaments extruded from the lower edge of the spinning nozzles to fall vertically a distance of at most about 0.8 meter;

quenching the filaments by means of transversely blowing air over said filaments at a temperature between about 20° C. to about 40° C.;

aerodynamically drawing the extruded filaments by means suffieient to create a filament withdrawal velocity between about 20 meters/second and 60 meters/second, and such that the ratio of the extrusion velocity to the withdrawal velocity is between about 1:200 and 1:1000;

forming a fabric web by depositing the aerodynamically drawn filaments onto a moving porous support that has a vacuum beneath it creating suction; and bonding the fabric web to provide the spun-bnded fabric, wherein said aerodynamically drawn filaments have a maximum tensile elongation of at least about 200%, and have a fiber shrinkage determined in boiling water of less than about 10%.

2. A method according to claim 1 wherein the polypropylene is atactic polypropylene having a molecular weight distribution such that at a temperature of about 280° C., and a shear velocity of about 362 l/s, said atactic polypropylene has a melt viscosity of about 45 Pa.sec+3%, at a shear velocity of about 3600 l/s, the melt viscosity is about 14 Pa.sec+2%, and at a shear velocity of about 14,480 l/s, the melt viscosity is about 6 Pa.sec+1.5%.

3. The method according to claim 1 wherein the cross-sectional area of the means which aerodynamically withdraws the filaments is adjusted relative to the number of filaments, so that light bundles constantly alternating between about 2 to 5 filaments each are formed, and the bundles are randomly deposited on the moving porous support.

4. A method according to claim 1 wherein the fabric web is bonded by means of a calender which comprises an engraved and a smooth cylinder, at a temperature of between about 130° C. and 160° C., and a line pressure of between about 40 and 500 N/cm.

5. A method according to claim 1, further comprising treatment of the spun-bonded fabric with a suitable wetting agent to provide the fabric with a surface tension of about $35\times10^{-5}$ N/cm.

6. The method according to claim 1 wherein the filaments have a maximum tensile elongation of at least about 400%.

7. The method according to claim 1 wherein the spun-bonded fabrics are characterized by a draping coefficient of less than or equal to 1.65 (area weight)+30%.

8. A method according to claim 1 wherein the filament withdrawal velocity is about 10 to 20 times the velocity of the moving porous support on which the fabric web is formed.

9. A method according to claim 2 wherein the filament withdrawal velocity is about 10 to 20 times the velocity of the moving porous support on which the fabric web is formed.

10. A method according to claim 1 further comprising oscillation of the aerodynamically drawn filaments as they are deposited onto the moving porous support, and wherein ths oscillation is characterized by a velocity vector transverse to the moving support's velocity vector, and also wherein said transverse velocity vector has a value between about 0 and 2 times that of the moving support's velocity vector.

11. A method according to claim 2 further comprising oscillation of the aerodynamically drawn filaments as they are deposited onto the moving porous support, and wherein this oscillation is characterized by a velocity vector transverse to the moving support's velocity vector, and also wherein said transverse velocity vector has a value between about 0 and 2 times that of the moving support's velocity vector.

12. A method according to claim 8 further comprising oscillation of the aerodynamically drawn filaments as they are deposited onto the moving porous support, and wherein this oscillation is characterized by a velocity vector transverse to the moving support's velocity vector, and also wherein said transverse velocity vector has a value between about 0 and 2 times that of the moving support's velocity vector.

13. A method according to claim 9 further comprising oscillation of the aerodynamically drawn filaments as they are deposited onto the moving porous support, and wherein this oscillation is characterized by a velocity vector transverse to the moving support's velocity vector, and also wherein said trasverse velocity vector has a value between about 0 and 2 times that of the moving support's velocity vector.

14. A method according to any one of claims 1, 2, 8, 9, 10, 11, 12 and 13 wherein said fabric web has a crossed parallel texture.

* * * * *

UNITED STATES PATENT AND TRADEMARK OFFICE

CERTIFICATE OF CORRECTION

PATENT NO. : 4,496,508

DATED : January 29, 1985

INVENTOR(S) : Ludwig Hartmann, Ivo Ruzek, Engelbert Löcher

It is certified that error appears in the above-identified patent and that said Letters Patent is hereby corrected as shown below:

On the Title Page, in the caption Inventors:

Please delete "Ivo Rüzek" and insert

--Ivo Ruzek--.

Signed and Sealed this

*Twentieth* Day of *August 1985*

[SEAL]

*Attest:*

DONALD J. QUIGG

*Attesting Officer* *Acting Commissioner of Patents and Trademarks*